US005593054A

United States Patent [19]

Glynn

[11] Patent Number: 5,593,054

[45] **Date of Patent: * Jan. 14, 1997**

[54] CHILD RESISTANT FLIP CAP WITH COLLAR

[75] Inventor: Kenneth P. Glynn, Raritan Township Hunterdon Cty., N.J.

[73] Assignee: Ideal Ideas, Inc., Flemington, N.J.

[ * ] Notice: The term of this patent shall not extend beyond the expiration date of Pat. No. 5,397,008.

[21] Appl. No.: 431,107

[22] Filed: Apr. 28, 1995

[51] Int. Cl.[6] ..... B65D 55/02

[52] U.S. Cl. ..... 215/225; 215/206; 215/223; 215/306

[58] Field of Search ..... 215/206, 223, 215/224, 225, 306; 220/375

[56] References Cited

U.S. PATENT DOCUMENTS

| | | | |
|---|---|---|---|
| 2,704,100 | 3/1955 | Freeman | 220/375 X |
| 3,469,725 | 9/1969 | Turner | 215/225 |
| 3,584,760 | 6/1971 | Grinker | 215/225 X |
| 3,612,322 | 10/1971 | Linkletter | 215/225 |
| 3,703,974 | 11/1972 | Boxer et al. . | |
| 3,782,578 | 1/1974 | Ballin . | |
| 4,095,718 | 6/1978 | Kong . | |
| 4,361,243 | 11/1982 | Virtanen . | |
| 5,004,114 | 4/1991 | Terbrusch et al. | 220/296 |
| 5,044,512 | 9/1991 | Giancaspro et al. | 220/375 X |
| 5,397,008 | 3/1995 | Glynn | 215/225 |
| 5,402,900 | 4/1995 | Glynn | 215/225 |

*Primary Examiner*—Stephen K. Cronin
*Attorney, Agent, or Firm*—Kenneth P. Glynn, Esq.

[57] ABSTRACT

The present invention is a container closure device, which includes a container, a collar ring, a semi-flexible tether and a cap. The container has a neck, an open top and a horizontal retainer track thereon for affixing a collar ring thereto. The collar ring has a circular inside wall with a horizontal track thereon for attachment to the track of the container so as to be horizontally and freely rotatable thereabout. The collar ring also has a top with a ledge thereon forming a horizontal arc track for frictionally engaging and retaining a cap, and has at least one cut out on the ledge to permit a cap to be inserted and removed from the collar ring. The cap has semi-flexible walls and has at least one protrusion which corresponds to and has a geometry of adequate size to freely move through the cut outs of the ledge of the collar ring and when the cap is so inserted and rotated, of adequate size and geometry to cause frictional engagement and to cause simultaneous rotation of the cap from the collar ring and to prevent removal of the cap from the collar ring, except when the cap and the collar ring are held separately and are rotated relative to one another such that the protrusions and the cut outs are in alignment for lift up removal of the cap from the collar ring. The semi-flexible tether has a first end connected to the collar ring and a second end connected to the cap. The tether operates to misalign the cap and collar ring upon reclosing.

13 Claims, 3 Drawing Sheets

CHILD RESISTANT FLIP CAP WITH COLLAR

BACKGROUND OF THE INVENTION

1. Field of the Invention

The present invention relates to child resistant caps, and more particularly to single caps with tethered safety rings for tubes, bottles and other capped containers.

2. Information Disclosure Statement

Safety caps have been well known for at least three decades and literally come in many hundreds of shapes and forms with diverse mechanisms for achieving safety. The objective of such devices is to slow down or prevent the opening of a dispenser by a child to ultimately reduce or prevent use of a medication or dangerous or hazardous material by a young child who may unwittingly consume some of the contents and suffer severe consequences. The following patents represent different variations on safety caps which exemplify the art:

U.S. Pat. No. 3,703,974 to Leo Boxer and Robert Boxer describes a safety cap and container combination wherein the container mouth includes a plurality of spaced ribs or flanges, each having a differently located, notched out passageway over which a cap member having at least one projecting internal lug is positioned in a single movement to close the container. In one form of the invention, a bead at the rim of the container mouth may be provided to mate with an internal groove in the cap member to seal tightly the cap member to the container. In order to remove the cap member, it is moved partially away from the container to disengage the bead from the groove and the lug member is then positioned and aligned with each slot and advanced therethrough in successive fashion to open the mouth of the container.

U.S. Pat. No. 3,782,578 to Gene Ballin sets forth a novel disposable closure. The device includes an opener for opening a closure cap along a score line around the base of an annular channel without piercing the cap. It includes a collar which rotatably and slidably engages the cap and includes a peripheral wall provided with circumferentially spaced depending arcuate teeth of greater thickness than the channel and stop elements which limit the downward movement of the device on the cap. The device is pressed downwardly and rotated so that the teeth wedge between and spread the channel walls to sever the closure along the full length of the score line. The piercing of the channel by the teeth is prevented by the stop elements.

U.S. Pat. No. 4,095,718 to Cheung Tung Kong describes a convertible safety cap. A cap is provided for closing a container having a locking portion for use in a precautionary arrangement to prevent children from obtaining access into the container. The cap is convertible so as to cooperate with such a container to provide not only such a precautionary arrangement but also an alternative easy opening arrangement. The invention includes a cap, an annular disk and a locking rim with notches through which tabs on the cap may pass.

U.S. Pat. No. 4,361,243 to Risto Virtinen describes a closing means for a container, tube or the like. This device is a closing means for a nozzle which is fixably mounting on a container or for a tube or the like. The closing means is openable when turned into a predetermined position which is indicated by indicators provided on the closing means and on the container. It is settable diametrically opposite each other, and characterized in that the lower rim of the closing means or the upper rim of the container is provided with a separate background ring extending at least partially behind the indicator of the closing means and the indicator of the container.

Notwithstanding the significant prior art in this field, it is believed that the present invention, which utilizes a rotatable safety collar (outer ring) with a tethered cap in the particular fashion described herein, is neither taught nor rendered obvious.

SUMMARY OF THE INVENTION

The present invention is a container closure device, which includes a container, a collar ring, a semi-flexible tether and a cap. The container has a neck, an open top and a horizontal retainer track thereon for affixing a collar ring thereto. The collar ring has a circular inside wall with a horizontal track thereon for attachment to the track of the container so as to be horizontally and freely rotatable thereabout. The collar ring also has a top with a ledge thereon forming a horizontal arc track for frictionally engaging and retaining a cap, and has at least one cut out on the ledge to permit a cap to be inserted and removed from the collar ring. The cap has semi-flexible walls and has at least one protrusion which corresponds to and has a geometry of adequate size to freely move through the cut outs of the ledge of the collar ring and, when the cap is so inserted and rotated, of adequate size and geometry to cause frictional engagement and to cause simultaneous rotation of the cap and the collar ring and to prevent removal of the cap from the collar ring, except when the cap and the collar ring are held separately and are rotated relative to one another such that the protrusions and the cut outs are in alignment for lift up removal of the cap from the collar ring. The semi-flexible tether has a first end connected to the collar ring and a second end connected to the cap. The tether has a rest position and a twisted position and it is connected to the collar ring and the cap at locations such that when the tether is in its rest position, the at least one protrusion is within the horizontal arc track of the collar ring, and the at least one protrusion and the at least one cut out are not in alignment, and such that when the cap is rotated relative to the ring and the tether is in a twisted position, the at least one cut out and the at least one protrusion are in alignment to permit lift up removal of the cap from the collar ring.

BRIEF DESCRIPTION OF THE DRAWINGS

The present invention will be more fully understood when the specification herein is taken in conjunction with the drawings appended hereto, wherein.

DETAILED DESCRIPTION OF THE INVENTION

Figure 1:
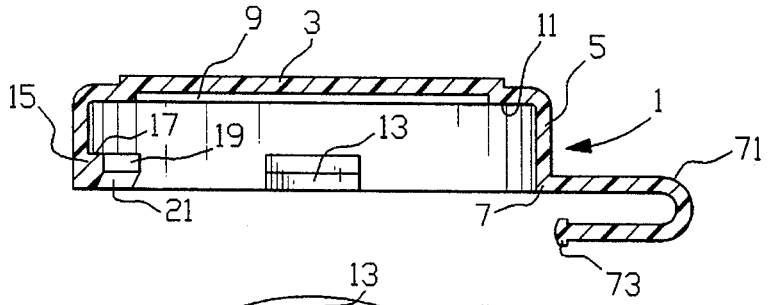
FIGS. 1 and 2 show a cut front view and a bottom view, respectively, of a cap and tether of a present invention container closure device.

The present invention is a container closure device. It includes a container with at least one retainer track, a cap, a tether and a collar ring. The container has a top portion with a circular horizontal retainer track thereon for attachment of the collar ring to the container. The ring is circular with a horizonal track on its inside wall for attachment to the retainer track of the container so as to connect them in such a way as to be freely horizontally rotatable thereabout, but otherwise permanently connected to one another. The collar ring also has a top with an inwardly or outwardly biased ledge which forms at least a horizontal arc track for retaining the cap and has at least one cut out and preferably more than one cut out on the ledge to permit the cap to be inserted and removed from the collar ring. The cap has a circular bottom adapted to be inserted into or onto the ring and thus over the top of the container. The bottom of the cap has at least one protrusion which corresponds to and has a geometry of adequate size to freely move through the cut out of the ledge of the collar ring for a predetermined distance, e.g. a specific length or angle of the horizontal arc track. When the cap is inserted and rotated, both the cap and the ring move together due to intentional friction caused by the tight fit between the cap and ring. In preferred embodiments, the surface of the cap which contacts the ring and/or the surface of the ring which contacts the cap, or both, is intentionally formed with non-smooth surfaces such as rough surface molding, cross-hatch surface molding or shallow serration molding.

The semi-flexible tether is connected no both the cap and the ring and acts not only as a tether, but also as an aligning mechanism. The tether has a rest position and a twisted position. The cap and ring are attached via the tether such that when the tether is in its rest (untwisted) position, the protrusion and cut out are not aligned, and when the cap is rotated relative to the ring it may be rotated so that the tether is twisted and the protrusion(s) and cut outs are aligned.

In order to remove the cap, the ring and cap must be rotated relative to one another so that the protrusion(s) is aligned with the cut out(s), as mentioned. This "firing" or opening position occurs when the tether is twisted. When the user opens the cap and lets the cap go to hold the container in one hand and empty a pill or the like in the other hand, the tether returns to its rest position, moving the protrusion(s) and cut outs(s) into non-alignment. When the cap is snapped back on, it is closed in the non-firing position. Thus, the tether is stiff enough to recover no its rest position to "align" the cap and ring into a non-firing position, i.e. align then so that protrusion(s) and cut out (s) are not aligned.

In preferred embodiments, the ledge of the ring has adequate flexibility to allow the cap to be pushed down without alignment of the protrusion and the cut out, but not to be removed unless alignment is first provided.

Figure 2:
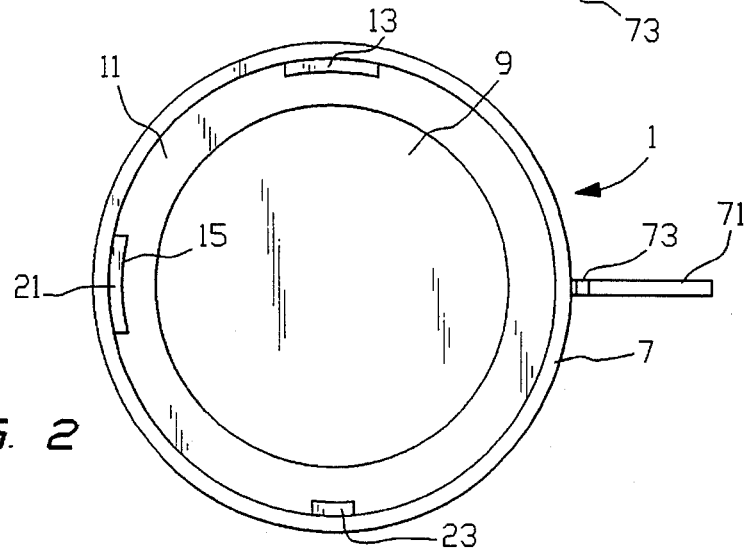

FIG. 1 shows a front cut view of a present invention container closure device cap 1 and FIG. 2 shows a bottom view thereof. As can be seen, cap 1 includes a top portion 3 and a sidewall 5 with an open bottom 7. Cap 1 further includes a recess 9 in top 3 to permit spacing for a foil seal or other seal for conventional medicine cap-type seal. There is a shoulder 11 which will be discussed in more detail with respect to FIG. 7. Additionally, there are shown three different protrusions 13, 15 and 23 (FIG. 2). Protrusion 15 has a tapered bottom 21 as do the other protrusions to allow cap 1 to be easily snapped onto a collar ring but not easily removed therefrom. Thus, protrusion 15 has tapered portion 21, vertical flat 19 and horizontal flat 17. This would be typical of one type of protrusion in preferred embodiments of the present invention. There is also a tether 71 attached at one end to sidewall 5 of cap 1. It is formed in a horizontal U-shape as shown and has adequate thickness to be semi-flexible, i.e. semi-rigid—so that it may be twisted but, when let go, it will recover to its rest position shown in these FIGS. 1 and 2. Tether 71 has a snap-in bead 73 for attachment to a collar ring.

Figure 3:
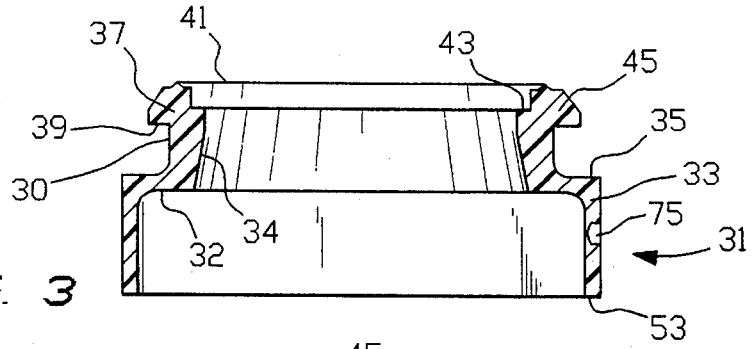
FIGS. 3 and 4 show a front cut view and a top view of a collar ring used with the cap and tether shown in FIGS. 1 and 2 above.
Figure 4:
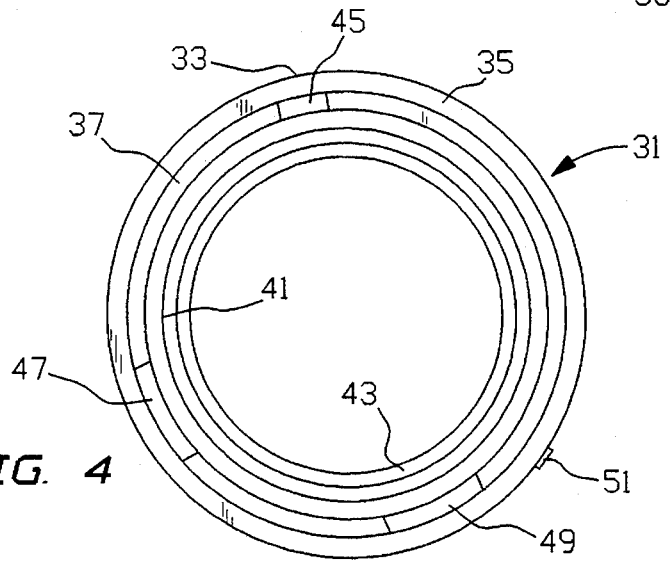

Referring now to FIGS. 3 and 4, there are shown a front cut view and a top view collar ring 31. Collar ring 31 includes side wall 33 and shoulder 35, as well as a ledge 39. This ledge 39 acts in conjunction with shoulder 35 to frictionally lock with the ledges of cap 1. The ledge establishes a horizontal track which may be formed over a predetermined length, i.e. a specific arc length or angle, or all the way around. However, since the tether 71 prevents complete rotation of the cap 1 relative to the collar, only an arc is necessary.

Top rim 41 of collar ring 3 seals with the underside of top 3 of cap 1. Further, as can be seen from the top view in FIG. 4, shoulder 35 protrudes beyond ledge 37 and this enables frictional contact with cap 1, as well as non-removable but rotational attachment to a container. It is the combination of upper ledge 43, protrusion 34 and underside 32 which constitutes a horizontal track within collar ring 31 for attachment to a container as described below. There is at least one cut out and, in this case, three cut outs 45, 47 and 49 of different sizes and arranged in a non-symmetrical manner so as to align with the protrusions of cap 1 in only a single orientation.

Referring to FIGS. 1 through 4 above, tether 71 has a snap-in bead 73 which may be permanently engaged into opening 75 of collar ring 31 so as to then function as mentioned above and more fully described in conjunction with FIGS. 5 and 6 below, to have a rest position for non-firing of the cap. Additionally, because the snap-in bead 73 may be rounded and opening 75 may likewise be rounded, bead 73, once snapped into opening 75 may rotate within opening 75 so as to act like a hinge pin. This is easily seen in FIG. 7 where tether 71 would have some rotational play relative to side wall 33.

Figure 5:
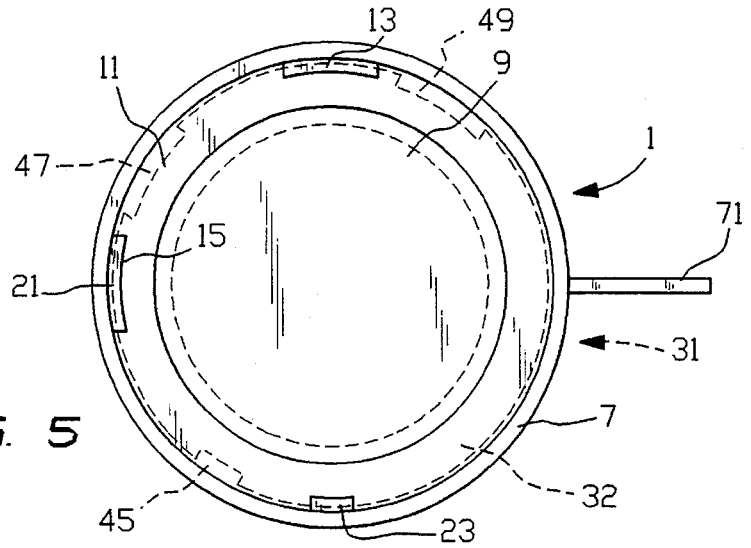
FIGS. 5 and 6 show top partial views of a cap, tether and collar ring in the tether rest position and the tether twisted position respectively.
Figure 6:
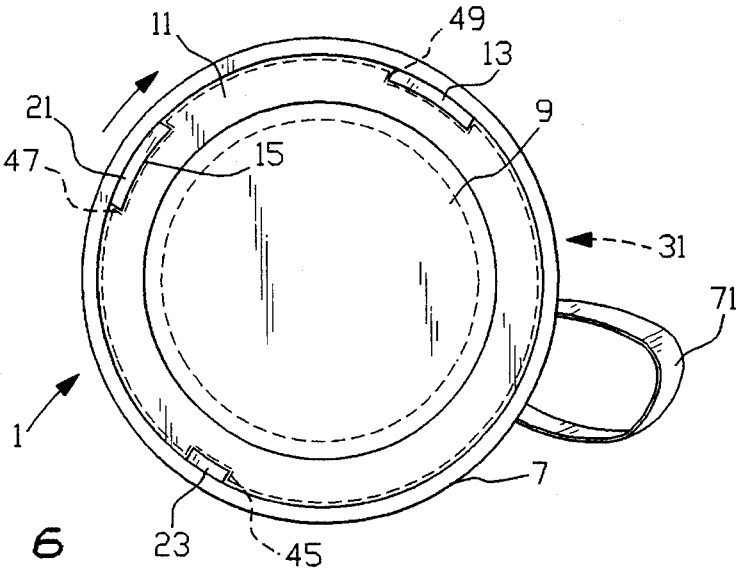

Referring to FIGS. 5 and 6, there is shown bottom view of cap 1 and a dotted lined overlay of collar 31, with tether 71 in its rest and its twisted positions, respectively. All parts shown in the previous Figures are identically numbered. FIG. 5 shows tether 71 at rest and with protrusions 13, 21 and 23 not aligned with collar cut outs 49, 47 and 45 respectively. Thus, if cap 1 were open, i.e. off collar 31, and tether 71 was in the rest position shown in FIG. 5, upon snapping cap 1 to collar 31, the aforesaid non-alignment of protrusions and cut outs would be achieved.

If a user then held collar 31 with one hand and cap 1 with the other hand and rotated the cap 1 as shown by the arrow in FIG. 6 (i.e., rotated the protrusions and cut outs toward one another) to achieve alignment of the protrusions and cuts outs, tether 71 would be twisted as shown in FIG. 6, and cap 1 could be fired, i.e. opened. The user would release cap 1 while open to take contents from a container to which collar ring 31 would be attached, and the tether 71 would spring back to its rest position, rotating cap 1 into a non-firing position (non-alignment of protrusions and cut outs) to assure a child resistant, safe closing every time.

Figure 7:
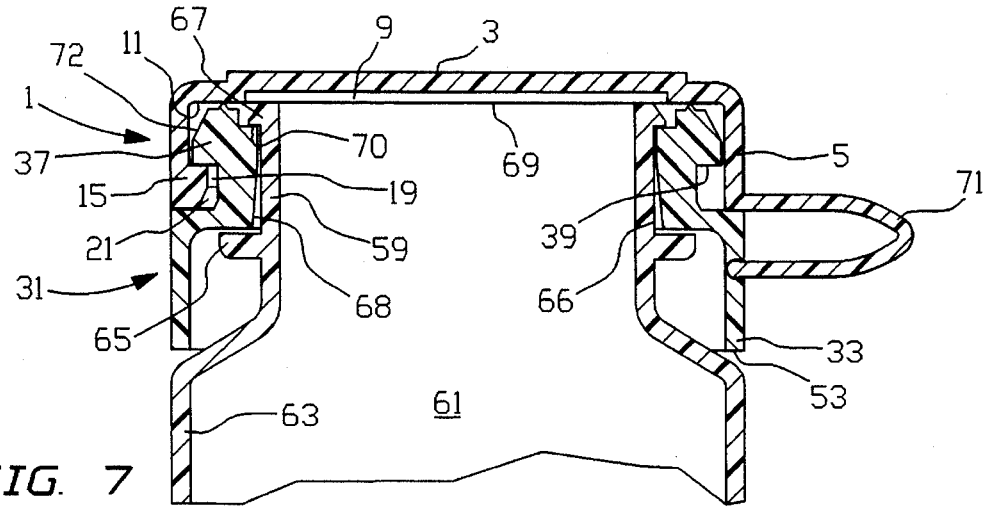
FIG. 7 shows a front cut view of the cap and tether of FIGS. 1 and 2 with the collar ring of FIGS. 3 and 4 attached to a container.

Referring to FIG. 7, there is shown the cap and tether of FIGS. 1 and 2 and the ring collar of FIGS. 3 and 4 with identical parts being identically numbered, along with container 61. Container 61 includes sidewall 63 with neck 59 and protrusions 65 and 67 so as to create a horizontal track thereabout shown as track 66. While track 66 is indented on container 61 and track 34 is protruding on the inside collar ring 31, they could be reversed without exceeding the scope of the present invention. There is an open top 69 to container 61 and collar ring 31 has been snapped onto container 61 so as to be non-removably attached thereto but freely rotatable thereabout. This is because inwardly tapered portion 68 allows collar ring 31 to pass over tapered ledge 67 but flat surface 70 does not permit collar ring 31 to be removed therefrom. Thus, collar ring 31 is freely rotatable but non-removable. Cap 1 has been snapped onto collar ring 21, as shown, and due to the tapered surfaces such as tapered wall 21 of protrusion 15, cap 1 can easily slide over the tapered edge 72 of collar ring 31 but cannot be removed therefrom. Further, because of the tight fit between protrusion 15 and ledge 37, there is frictional engagement of cap 1 with collar ring 31 so than when either collar ring 31 or cap 1 is rotated, the other will rotate along with it. On the other hand, if a user holds cap 1 with one hand and holds collar ring 31 with the other hand and rotates cap 1 relative to collar ring 31, as, for example, by virtue of alignment markings such as alignment mark 51 shown in FIG. 4, then the protrusions 13, 15 and 23 will be in alignment with cut outs 47, 49 and 45 respectively so that cap 1 can then be lifted up and easily removed from collar ring 31. Tether 71 retains the cap 1 and recovers it to a non-firing position for closing when released. Tether 71 also prevents complete 360° rotation of cap 1 relative to ring 31, and rotation of, for example 15° to 40°, from non-firing to firing positions, may be preferred. Thus, by virtue of the embodiment shown in FIGS. 1 through 7, the present invention device will be child resistant and will also be friendly to people with dexterity difficulties such as senior citizens due to the ease with which the frictional engagement of the cap and collar ring may be overcome for subsequent removal of the cap.

The above embodiment shows the horizontal track of the container being indented, but as indicated, it could be a protrusion and the inward protrusion horizontal track of the collar could likewise be reversed so as to engage one another so that the collar ring could not be removed but could be freely rotated. Likewise, the protrusion on the cap could well be an indentation and the indentation created on the collar ring could be a protrusion, without exceeding the scope of the present invention. Also, the version shown in the above figures illustrates the cap being inserted into the collar ring by being snapped onto the outside of the collar ring. Conversely, the cap could be snapped into the inside of the collar ring without exceeding the scope of the present invention and one such embodiment is discussed below.

Figure 8:
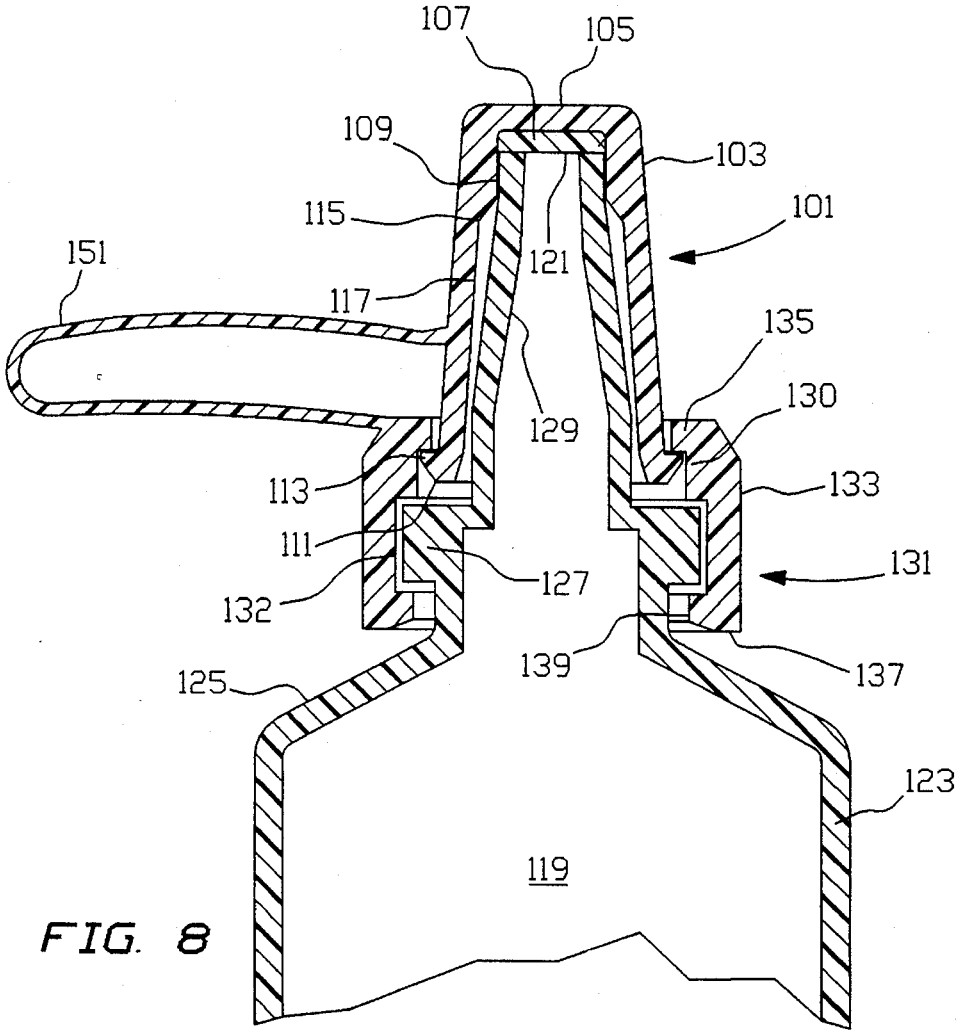
FIG. 8 shows a cut front view of an alternative embodiment cap, tether, ring and container of a present invention device; and, FIG. 9 shows a partial cut view of a present invention device utilizing an alternative mechanism for hinging the tether.

Referring now to FIG. 8, there is shown a front cut view of an alternative embodiment present invention device which includes cap 101, nether 151, collar ring 131 and container 119. Here, cap 101 includes sidewall 103 and a top 105 along with a compression seal 107 such as is conventionally used in sealed caps such as a plasticized foam or foil insert. Cap 101 has a narrow portion 109, a widening taper 115 and a wider portion 117, as shown. Additionally, at its bottom 111, there is a protrusion 113 which, in this case, is biased outwardly. This fits under horizontal track 130 of collar ring 131, as shown and there will be at least one and preferably more than one cut out in ledge 135 thereof. In other words, as shown in the figure, there is an arrangement similar to that in FIG. 5 but reversed and slightly different. In this case, the container 119, with its sidewall 123, shoulder 125 and horizontal track 127 protruding outwardly, also has a tapering portion 129 and an open end top 121. The friction between the underside of ledge 135 against protrusion 113 as well as the friction between top 125 and the underside of top 105 causes frictional engagement between collar ring 131 and cap 101. Horizontal track 127 of container 119 receives collar ring 131 so that horizontal track 132 of collar ring 131 is non-removably but rotatably engaged therewith. Thus, a user will separately hold collar ring 131 and cap 101 and rotate them relative to one another to align the protrusions such as protrusion 113 with cut outs in ledge 135 for lift up removal of cap 101 from container 119 without removing collar ring 133. The functional operation is generally the same as described above with respect to FIG. 7. Note, however, that in this embodiment, tether 151 is integrally formed with both the cap and the collar and could be molded as a single piece.

Figure 9:
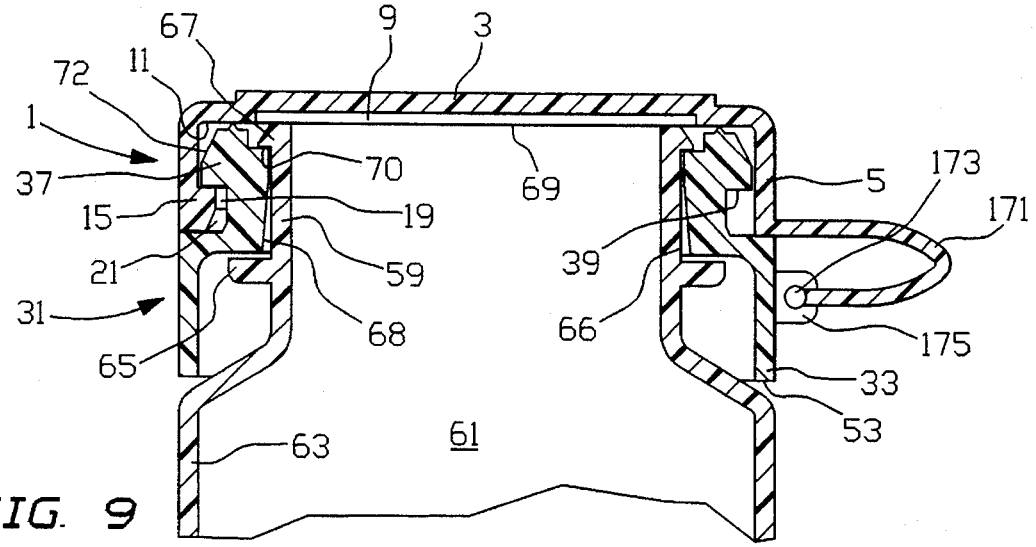

FIG. 9 shows a variation of the device shown in FIG. 7 with identical parts identically numbered except that tether 171 has unistructurally formed hinge pins such as pin 173 which are inserted into a pair of female hinge plates such as hinge plate 175. Much like bead 73 and its rotational ability within opening 75, the pins such as pin 173 and the hinge plate such as hinge plate 175 allow for rotation of the tether so that top 3 may be removed by twisting and lifting, as described above, and, further due to the hinge rotatability, may be rotated totally away from the open top 69 of container 61.

Thus, the embodiment shown in FIG. 9, as well as that shown in FIG. 7, and other perceived embodiments, may be used with an open neck container as shown in the drawings or with a container having a small center hole with the underside of the cap including a plug, such as for shampoo, lighter fluid or the like.

Obviously, numerous modifications and variations of the present invention are possible in light of the above teachings. For example, some protrusions or all protrusions and cut outs could have reversed positions. They could be the same size and be non-symmetrically arranged. They could be different sizes and be symmetrically or non-symmetrically aligned. It is therefore understood that within the scope of the appended claims, the invention may be practiced otherwise than as specifically described herein.

What is claimed is:

1. A container and closure device therefor, which comprises:

(a) a container having a neck, an open top and a horizontal retainer track thereon, adapted to receive and rotatably affix a collar ring thereto;

(b) a collar ring having a circular inside wall with a horizontal track thereon for attachment to the track of said container so as to connect said collar ring to said container so as to be horizontally and freely rotatable thereabout, said collar ring also having a top with a ledge thereon for frictionally engaging and retaining a cap, said ledge forming at least a horizontal arc track thereon of a predetermined length, for rotation of at least one protrusion of a cap to be rotated therein for a predetermined distance when frictional engagement is overcome, and said ledge having at least one cut out thereon to permit a cap to be inserted and removed from said collar ring;

(c) a cap having semi-flexible walls and having at least one protrusion which corresponds to and has a geometry of adequate size to freely move through said at least one cut out of said ledge of said collar ring and to be rotatable within said horizontal arc track of said collar ring for a predetermined distance when frictional engagement is overcome, and such that when said cap is so inserted and rotated, said at least one protrusion also being of adequate size and geometry to cause frictional engagement between said cap and said ring and to cause simultaneous rotation of said cap and said collar ring when at least one of said cap and collar ring is rotated, and to prevent removal of said cap from said collar ring, except when said cap and said collar ring are held separately and are rotated relative to one another such that said at least one protrusion and said at least one cut out are in alignment for lift up removal of said cap from said collar ring; and, (d) a semi-flexible tether having a first end connected to said collar ring and having a second end connected to said cap, said tether having a rest position and a twisted position, said tether being connected to said collar ring and said cap at locations such that when said tether is in its rest position, said at least one protrusion is within said horizontal arc track of said collar ring, and said at least one protrusion and said at least one cut out are not in alignment, and such that when said cap is rotated relative to said ring and said tether is in a twisted position, said at least one cut out and said at least one protrusion are in alignment to permit lift up removal of said cap from said collar ring.

2. The device of claim 1 wherein said ledge of said collar ring is biased inwardly relative to said circular inside wall of said collar ring and wherein said at least one protrusion of said cap is biased outwardly relative to said semi-flexible walls of said cap, and said cap fits on the inside of said collar ring and fits over said open top and outside of at least a portion of said neck of said container.

3. The device of claim 1 wherein said ledge of said collar ring has three cut outs thereon.

4. The device of claim 3 wherein said cut outs are not symmetrically arranged around said ledge.

5. The device of claim 1 wherein said ledge of said collar ring is biased outwardly relative to said circular inside wall of said collar ring and wherein said at least one protrusion of said cap is biased inwardly relative to said semi-flexible walls of said cap and said cap fits on the outside of said collar ring and fits over said open top and outside of at least a portion of said neck of said container.

6. The device of claim 1 wherein said ledge of said collar ring has at least three cut outs thereon.

7. The device of claim 6 wherein said cut outs are non-symmetrically arranged.

8. The device of claim 1 wherein at least one of said ledge and said at least one protrusion is downwardly flexible so as to permit insertion of said cap without alignment of said at least one protrusion and said at least one cut out, and is upwardly inflexible so as to prevent removal of said cap from said collar ring, except when said at least one protrusion and said at least one cut out are in alignment.

9. The device of claim 8 wherein said ledge has at least two cut outs thereon.

10. The device of claim 9 wherein said at least two cut outs are non-symmetrically arranged.

11. The device of claim 1 wherein said tether is integrally formed with at least one of said cap and said collar ring.

12. The device of claim 1 wherein said tether is integrally formed with both of said cap and said collar ring.

13. The device of claim 1 wherein one of said cap and said collar ring has a hinge component attachable to said tether and said tether is attached to the other of said cap and said collar ring and said tether has attachment means for attachment to said hinge component.

* * * * *